US009963922B2

(12) United States Patent
Tsou

(10) Patent No.: US 9,963,922 B2
(45) Date of Patent: May 8, 2018

(54) HINGE DEVICE WITH A MAGNETIC RETAINING FUNCTION

(71) Applicant: Kuo-Ho Tsou, Toufen (TW)

(72) Inventor: Kuo-Ho Tsou, Toufen (TW)

( * ) Notice: Subject to any disclaimer, the term of this patent is extended or adjusted under 35 U.S.C. 154(b) by 78 days.

(21) Appl. No.: 15/209,800

(22) Filed: Jul. 14, 2016

(65) Prior Publication Data

US 2018/0016826 A1 Jan. 18, 2018

(51) Int. Cl.
*E05D 11/10* (2006.01)
*E05D 3/02* (2006.01)

(52) U.S. Cl.
CPC ..... *E05D 11/1014* (2013.01); *E05D 3/02* (2013.01); *E05D 11/10* (2013.01); *E05D 11/1007* (2013.01)

(58) Field of Classification Search
CPC ..... E05D 3/02; E05D 11/10; E05D 11/1007; E05D 11/1014; E05D 11/1078
USPC ..... 16/320, 321, 322, 329, 330
See application file for complete search history.

(56) References Cited

U.S. PATENT DOCUMENTS 104,359 A * 6/1870 Sage ..... E05D 11/1014 16/332
121,309 A * 11/1871 Amos ..... E05D 11/1007 16/353
226,042 A * 3/1880 Cummings ..... E05D 11/1007 16/353
543,533 A * 7/1895 Krupp ..... E05D 11/1007 16/353
773,717 A * 11/1904 Craver et al. ..... E05D 11/1078 16/329
1,837,204 A * 12/1931 Chester ..... E05D 11/1007 16/343
8,272,101 B2 * 9/2012 Wagner ..... E05D 3/08 16/231
8,522,400 B1 * 9/2013 Jablonski ..... E05D 11/1007 16/320
8,707,521 B1 * 4/2014 MacK ..... E05D 11/06 16/326
9,074,397 B2 * 7/2015 MacK ..... E05D 11/06
2006/0112516 A1 * 6/2006 Chen ..... G06F 1/1616 16/330

* cited by examiner

*Primary Examiner* — Roberta S Delisle
(74) *Attorney, Agent, or Firm* — Alan D. Kamrath; KKamrath IP Lawfirm, P.A.

(57) ABSTRACT

A hinge device (10) includes a first connecting member (1) having a receiving section (11). An axle member (3) is mounted in the receiving section (11) and includes an axle (32) located outside of the receiving section (11). A second connecting member (2) includes an axle receiving portion (21) having a pivotal compartment (22) that pivotably receives the axle (32). A fixing groove (23) is defined in an inner periphery of the pivotal compartment (22) and receives a magnetic member (4) having a magnetically attractive portion (41) located in the pivotal compartment (22). When the first connecting member (1) and the axle member (3) pivot, the axle (32) pivots between a first position adjacent to the magnetically attractive portion (41) and a second position away from the magnetically attractive portion (41). The axle (32) in the first position is attracted and positioned by the magnetically attractive portion (41).

6 Claims, 11 Drawing Sheets

A-A

B–B

C–C

D-D

HINGE DEVICE WITH A MAGNETIC RETAINING FUNCTION

BACKGROUND OF THE INVENTION

The present invention relates to a hinge device and, more particularly, to a hinge device capable of retaining a door in an open position by a magnetic force.

A hinge generally includes two connecting members pivotably connected to each other and respectively mounted to a door frame and a door, permitting the door to pivot relative to the door frame. However, the hinge does not provide a positioning effect. If it is desired to retain the door in an open state, a retaining member disposed on the door and/or the ground is required, which is inconvenient.

Furthermore, a base for fixing the retaining member will adversely affect the interior decoration no matter the base is mounted to a wall or the ground. Furthermore, the installation provision of the retaining member for providing a magnetic attraction force adversely affects the design and appearance of the door.

Thus, a need exists for a novel hinge device that mitigates and/or obviates the above disadvantages.

BRIEF SUMMARY OF THE INVENTION

The primary objective of the present invention is to provide a hinge device mounted to a door. After the door has reaches a certain opening angle, the hinge device provides a magnetic attraction force therein to provide a retaining function, such that the door can be opened smoothly. The structure of the hinge device is simple and has a low cost.

To fulfill the above objective, the present invention provides a hinge device including a first connecting member adapted to be mounted to a door. The first connecting member includes a receiving section. An axle member is mounted in the receiving section of the first connecting member and includes an axle located outside of the receiving section. A second connecting member is adapted to be mounted to a door frame to which the door is pivotably mounted. The second connecting member includes an axle receiving portion having a first end and a second end. A pivotal compartment is defined in the first end of the axle receiving portion. The axle pivotably is received in the pivotal compartment. A fixing groove is defined in an inner periphery of the pivotal compartment. A magnetic member is mounted in the fixing groove. The magnetic member includes a magnetically attractive portion located in the pivotal compartment. When the first connecting member and the axle member pivot, the axle of the axle member pivots between a first position adjacent to the magnetically attractive portion and a second position away from the magnetically attractive portion. The axle in the first position is attracted and positioned by a magnetic attraction force of the magnetically attractive portion.

The receiving section of the first connecting member includes an end facing the axle receiving portion of the second connecting member. A positioning compartment can be is defined in the end of the receiving section of the first connecting member. The axle of the axle member can include a positioning portion positioned in the positioning compartment. The axle is located outside of the positioning compartment.

The positioning compartment of the receiving section of the first connecting member can include an inner periphery having an annular positioning groove. The positioning portion of the axle member can include a receptacle defined in an outer periphery thereof. An elastic element and a limiting pin are received in the receptacle. The limiting pin is biased by the elastic element to extend out of the receptacle. A distal end of the limiting pin is received in the annular positioning groove.

The axle can include a column received in the pivotal compartment. The column includes a cutout in a side thereof and a magnetic attraction leg delimiting the cutout. The magnetic attraction leg includes an abutment face. The magnetically attractive portion of the magnetic member is located in the cutout. When the axle is in the first position adjacent to the magnetically attractive portion, the magnetically attractive portion attracts the abutment face of the magnetic attraction leg to position the first connecting member 1 relative to the second connecting member.

The column can include an end face facing the cutout, and a first positioning hole can be defined in the end face of the column. A second positioning hole can be defined in a bottom wall of the pivotal compartment of the axle receiving portion. A post is mounted in the pivotal compartment and includes two ends respectively received in the first and second positioning holes. The magnetically attractive portion of the magnetic member includes a recessed abutment surface abutting an outer periphery of the post.

The axle receiving portion can further include an annular positioning groove in the inner periphery of the pivotal compartment. The axle can include a receptacle in an outer periphery thereof. An elastic element and a limiting pin are received in the receptacle. The limiting pin is biased by the elastic element to extend out of the receptacle, and a distal end of the limiting pin is received in the annular positioning groove.

The present invention will become clearer in light of the following detailed description of illustrative embodiments of this invention described in connection with the drawings.

DETAILED DESCRIPTION OF THE INVENTION

Figure 1:
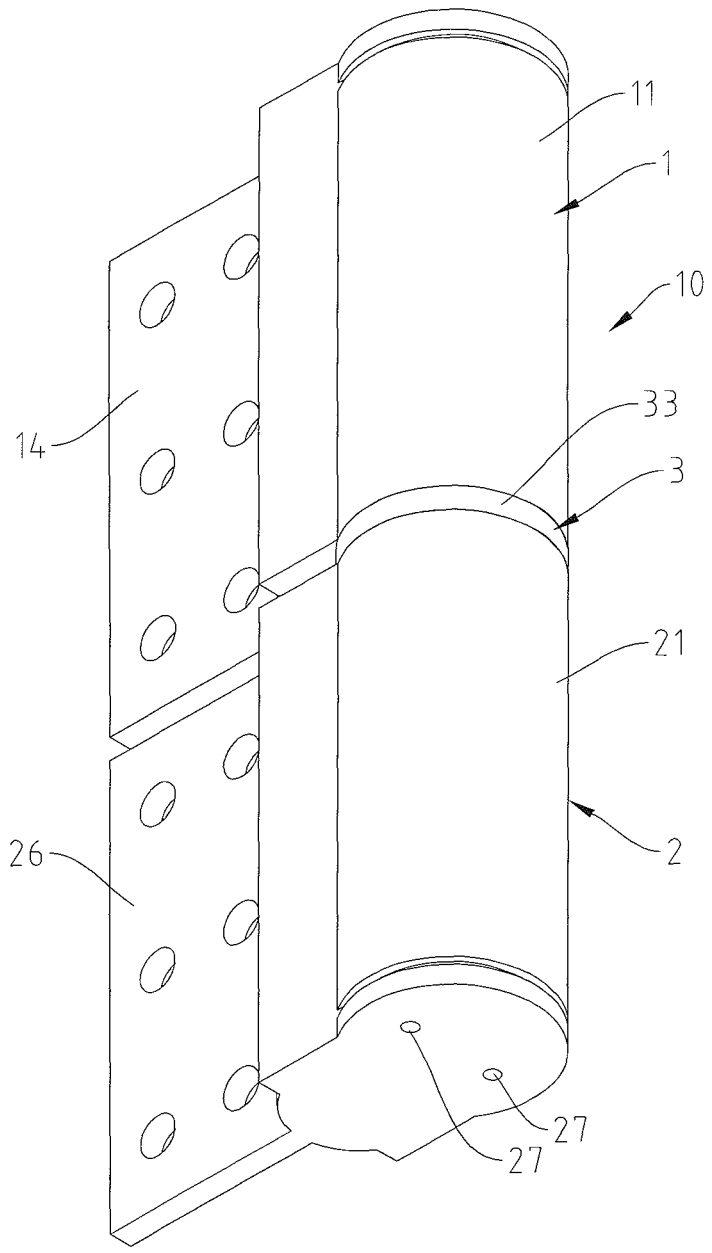
FIG. 1 is a perspective view of a hinge device according to the present invention.

With reference to FIGS. 1-7, a hinge device 10 according to the present invention includes a first connecting member 1, a second connecting member 2, an axle member 3, and a magnetic member 4.

The first connecting member 1 is adapted to be mounted to a door 8. The first connecting member 1 includes a receiving section 11. A connecting portion 14 extends from a side of the receiving section 11. A positioning compartment 12 is defined in an end of the receiving section 11 of the first connecting member 1. The positioning compartment 12 of the receiving section 11 of the first connecting member 1 includes an inner periphery having an annular positioning groove 13. A transmission groove 15 is formed in a bottom wall of the positioning compartment 12 and has square cross sections.

The second connecting member 2 is adapted to be mounted to a door frame 9 to which the door 8 is pivotably mounted. The second connecting member 2 includes an axle receiving portion 21. A second connecting portion 26 extends from a side of the axle receiving portion 21. The axle receiving portion 21 has first and second ends. The first end of the axle receiving portion 21 faces the positioning compartment 12. A pivotal compartment 22 is defined in the first end of the axle receiving portion 21. A fixing groove 23 and an annular positioning groove 25 are defined in an inner periphery of the pivotal compartment 22. The fixing groove 23 is located adjacent to a bottom wall of the pivotal compartment 22. A second positioning hole 24 is defined in the bottom wall of the pivotal compartment 22. Furthermore, a through-hole 27 extends from the bottom wall of the pivotal compartment 22 to an end face of the second end of the axle receiving portion 21 for discharging air or water.

The axle member 3 is made of metal and includes a positioning portion 31, an axle 32, and an abutment portion 33 in the form of a flange between the positioning portion 31 and the axle 32. The axle 32 includes a column 321 received in the pivotal compartment 22. The column 321 includes a cutout 322 in a side thereof and a magnetic attraction leg 325 delimiting the cutout 322. The magnetic attraction leg 325 includes an abutment face 323. The column 321 includes an end face facing the cutout 322. A first positioning hole 324 is defined in the end face of the column 321. A transmission column 312 is formed on an end of the positioning portion 31 and is securely engaged in the transmission groove 15 of the first connecting member 1.

The positioning portion 31 of the axle member 3 includes a receptacle 311 defined in an outer periphery thereof. An elastic element 5 and a limiting pin 6 are received in the receptacle 311. The limiting pin 6 is biased by the elastic element 5 to extend out of the receptacle 311, and a distal end of the limiting pin 6 is received in the annular positioning groove 13.

The axle 32 includes a receptacle 326 in an outer periphery thereof. An elastic element 5 and a limiting pin 6 are received in the receptacle 311. The limiting pin 6 is biased by the elastic element 5 to extend out of the receptacle 326, and a distal end of the limiting pin 6 is received in the annular positioning groove 25.

The magnetic member 4 is mounted in the fixing groove 23. The magnetic member 4 includes a base 43 and a magnetically attractive portion 41 disposed on the base 43 and located in the pivotal compartment 22. The magnetically attractive portion 41 of the magnetic member 4 includes a recessed abutment surface 42.

In assembly, the transmission column 312 of the axle member 3 is fixed in the transmission groove 15, and the distal end of the limiting pin 6 in the receptacle 311 of the positioning portion 31 is received in the annular positioning groove 13. Thus, when the first connecting member 1 pivots, the axle 3 also pivots 3. Then, the base 43 of the magnetic member 4 is disposed in the fixing groove 23 of the second connecting member 2, and the magnetically attractive portion 41 is located in the pivotal compartment 22. An end of a post 7 extends into the second positioning hole 24 of the second connecting member 2, and the recessed abutment surface 42 abuts an outer periphery of the post 7. Then, the axle 32 is pivotably mounted in the pivotal compartment 22 of the second connecting member 2, and the magnetically attractive portion 41 is located in the cutout 322. The other end of the post 7 extends into the first positioning hole 324. An end face of the receiving section 11 and an end face of the axle receiving portion 21 abut opposite sides of the abutment portion 33. The distal end of the limiting pin 6 in the receptacle 326 of the axle 32 is located in the annular positioning groove 25 of the second connecting member 2.

When the first connecting member 1 pivots and, thus, pivot the axle member 3, the axle 32 of the axle member 3 pivots between a first position (FIG. 9) adjacent to the magnetically attractive portion 41 and a second position (FIG. 4) away from the magnetically attractive portion 41.

Figure 2:
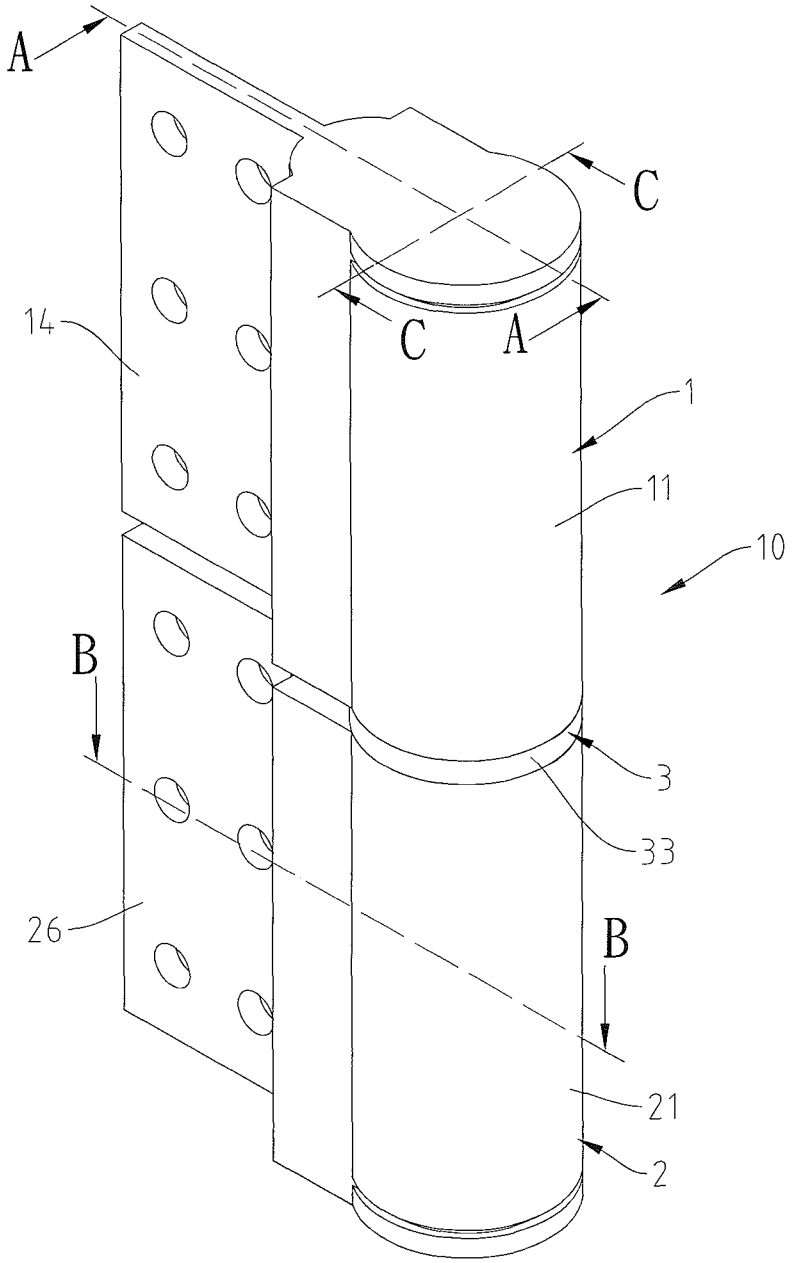
FIG. 2 is another perspective view of the hinge device of FIG. 1.
Figure 3:
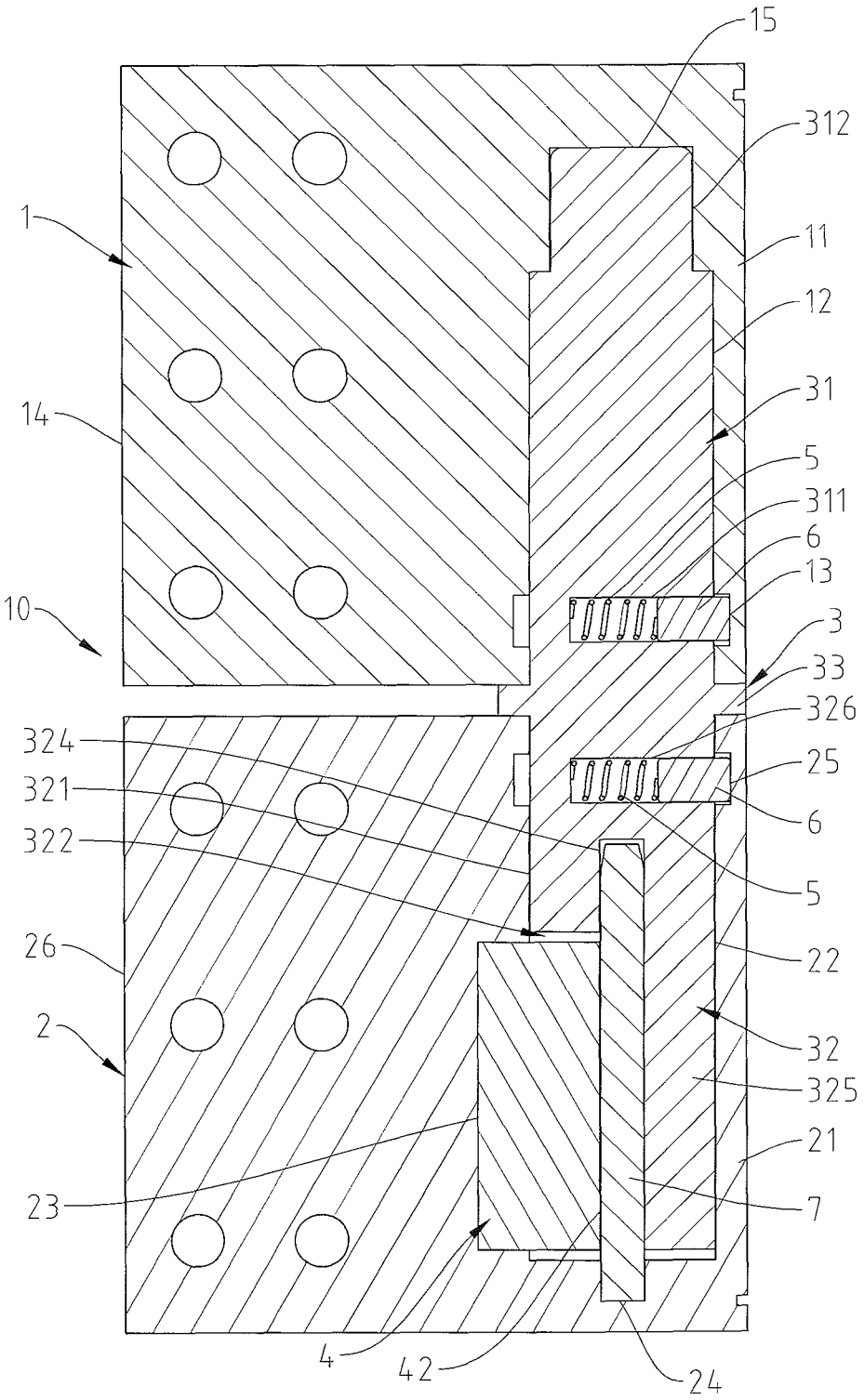
FIG. 3 is a cross sectional view taken along section line A-A of FIG. 2.
Figure 4:
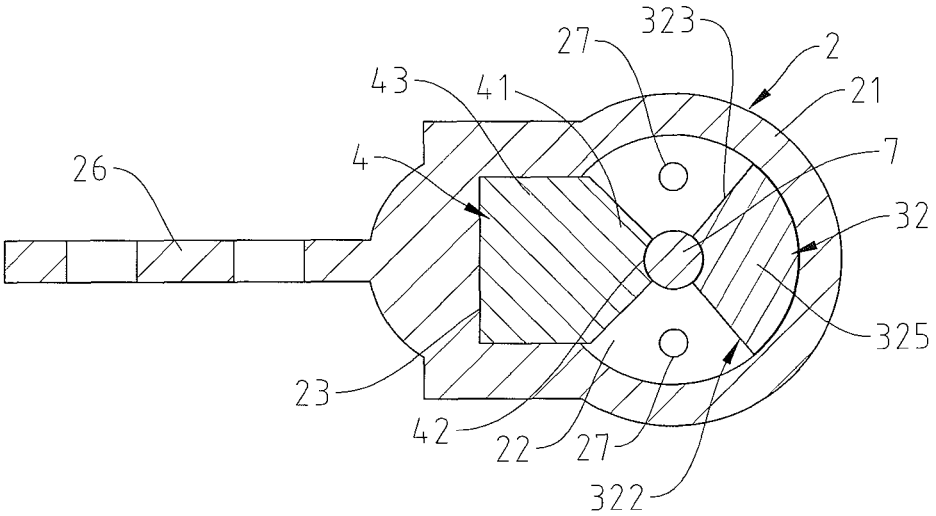
FIG. 4 is a cross sectional view taken along section line B-B of FIG. 2.
Figure 5:
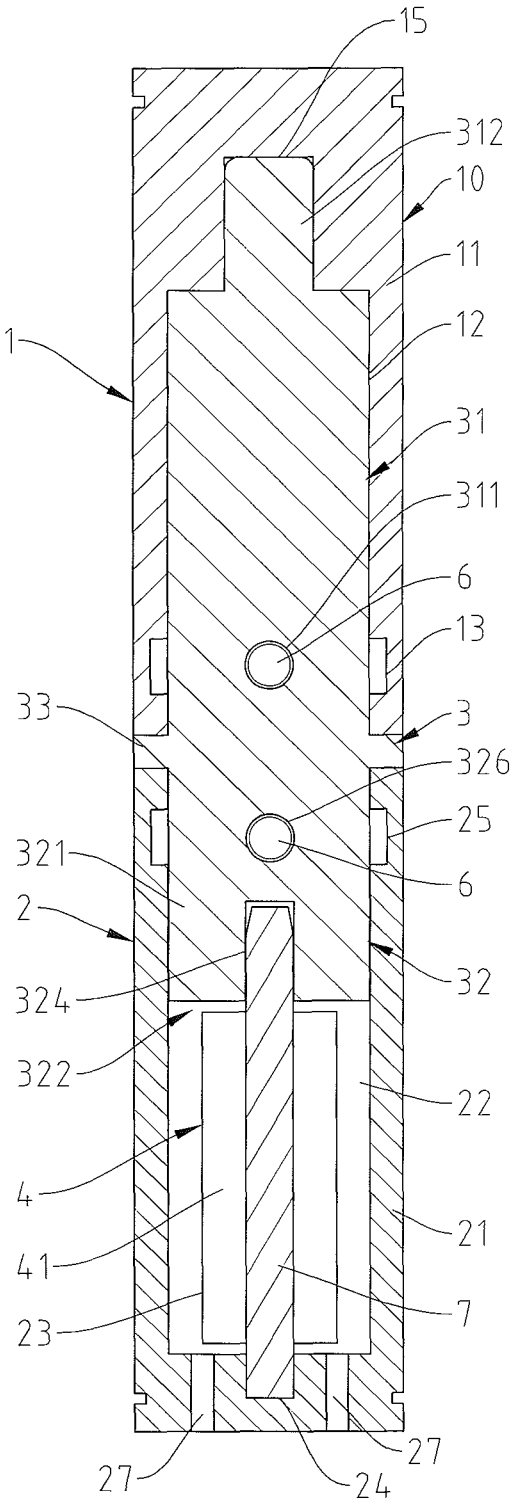
FIG. 5 is a cross sectional view taken along section line C-C of FIG. 2.
Figure 6:
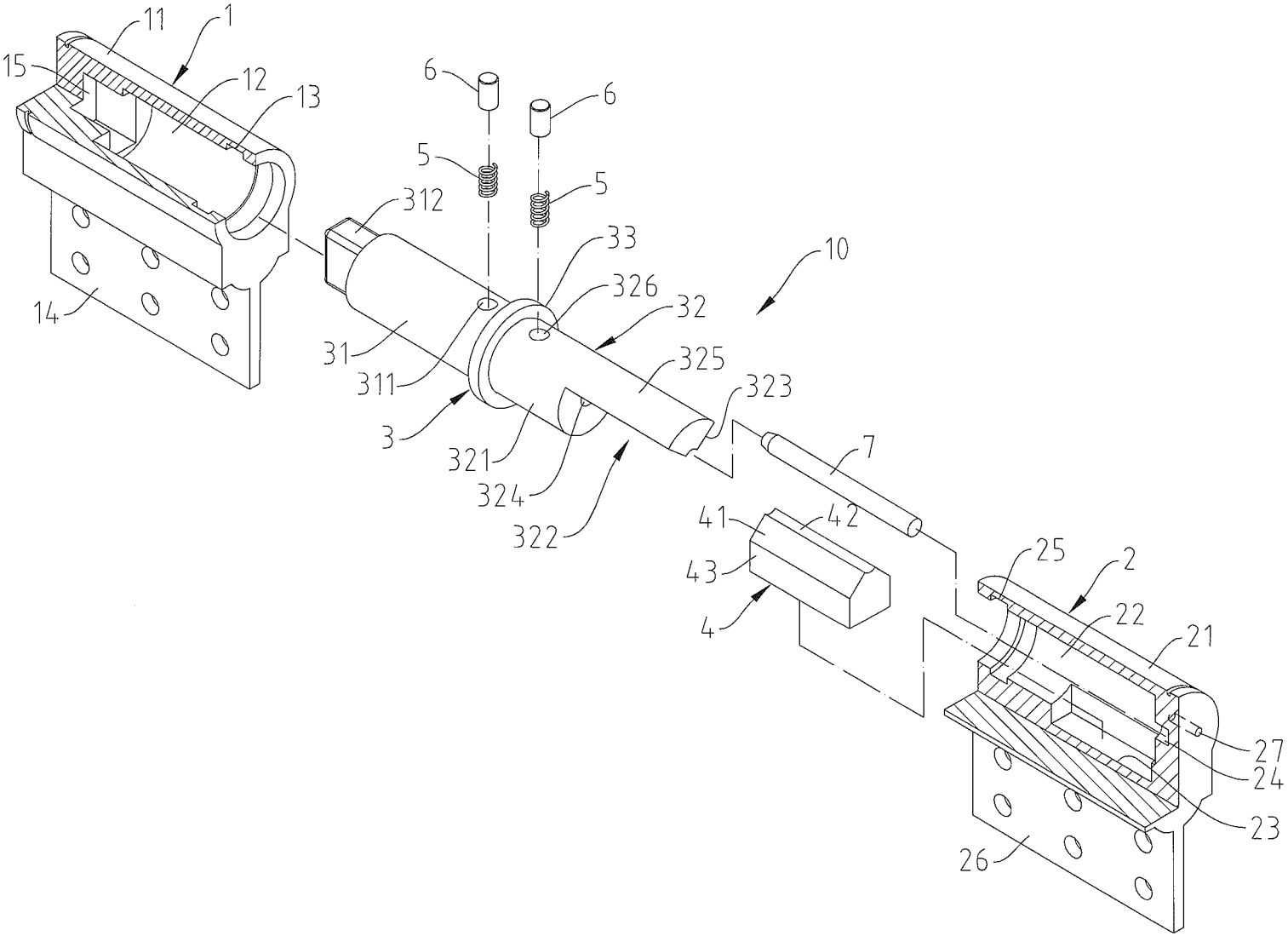
FIG. 6 is an exploded perspective view of the hinge device of FIG. 1.
Figure 7:
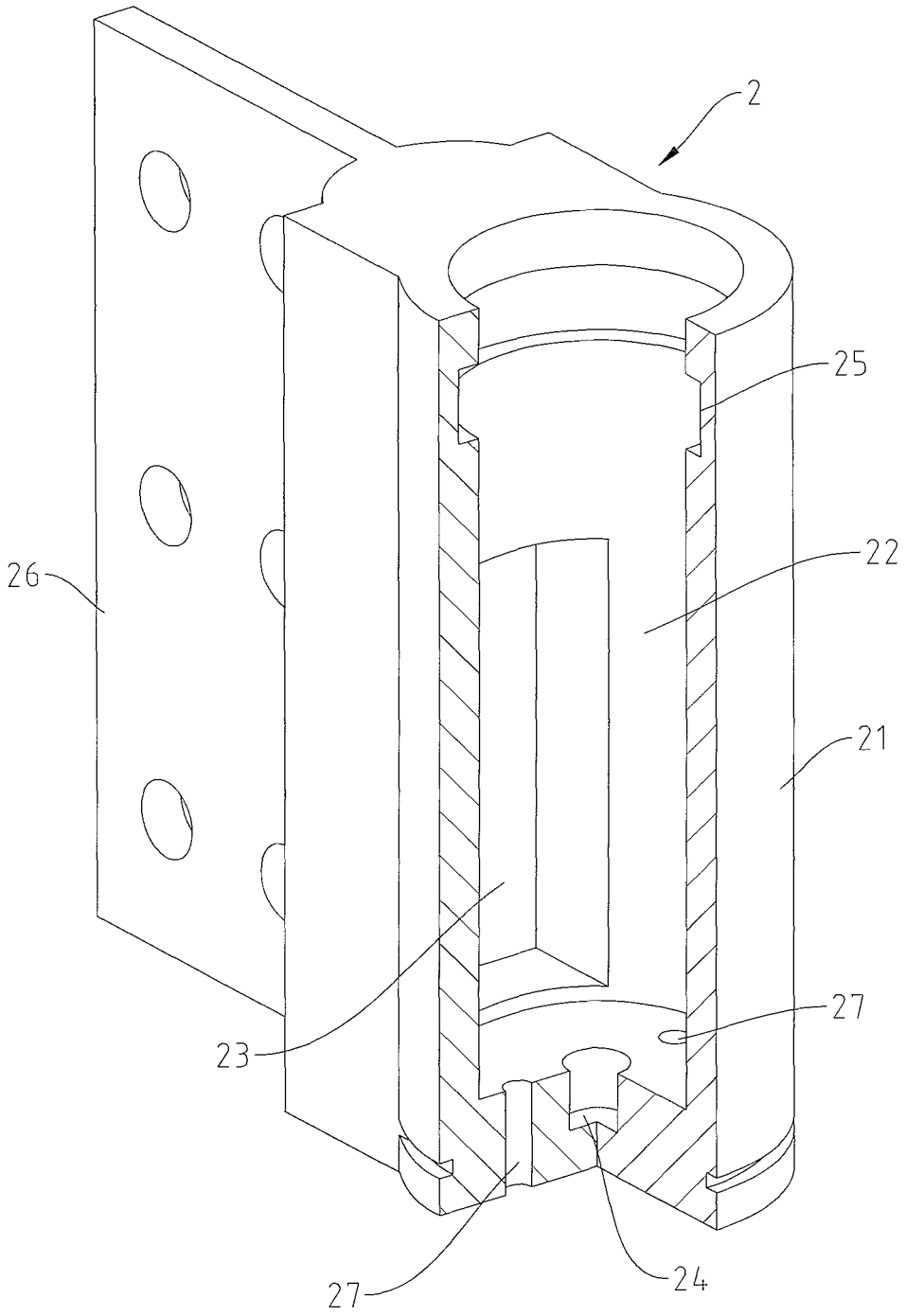
FIG. 7 is a party-cutaway perspective view of a second connecting member of the hinge device of FIG. 1.
Figure 8:
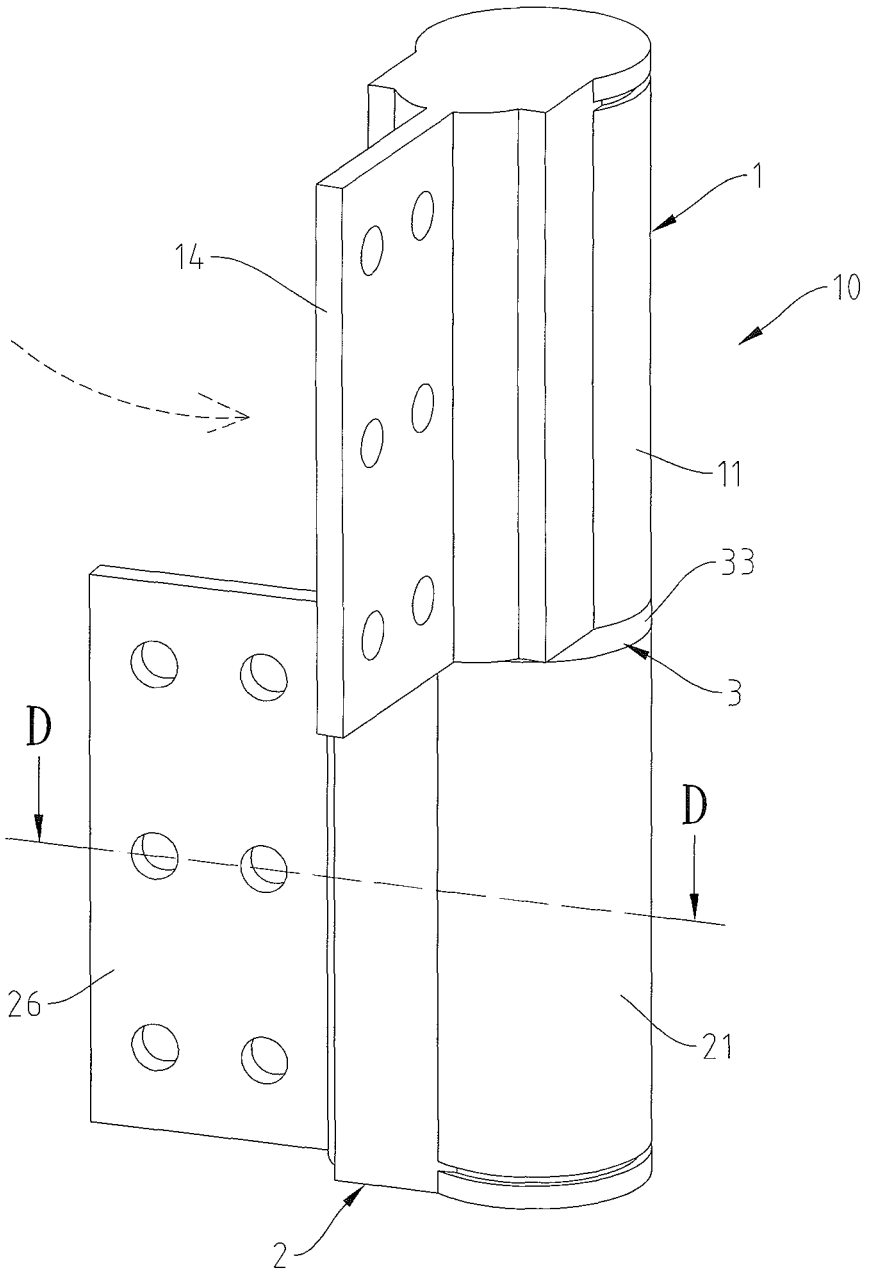
FIG. 8 is a perspective view of the hinge device in a position providing a magnetic force for retaining the position.
Figure 9:
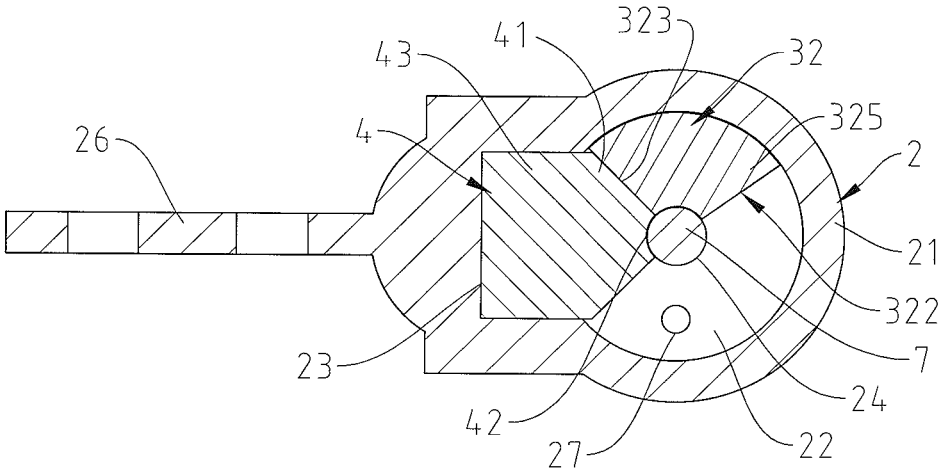
FIG. 9 is a cross sectional view taken along section line D-D of FIG. 8.

With reference to FIGS. 2 and 4, when the first connecting portion 14 of the first connecting member 1 is parallel to the second connecting portion 26 of the second connecting member 2, the magnetic attraction leg 325 of the axle 32 is distant from the magnetically attractive portion 41 of the magnetic member 4. With reference to FIGS. 8 and 9, when the first connecting member 1 and the axle 3 pivot to a position (corresponding to the first position of the axle 32), the magnetic attraction leg 325 of the axle 32 is adjacent to the magnetically attractive portion 41 of the magnetic member 4. The magnetically attractive portion 41 attracts the magnetic attraction leg 325 to position the first connecting member 1 relative to the second connecting member 2. Thus, the interior of the hinge device 10 provides a retaining function by the magnetic force.

Figure 10:
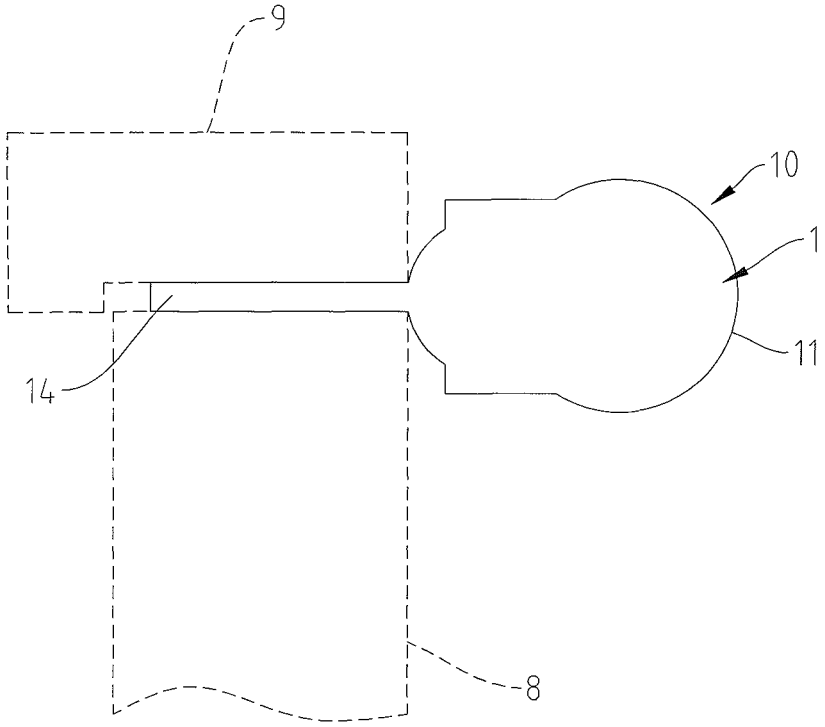
FIG. 10 is a schematic diagram illustrating the hinge device mounted to a door and a door frame.
Figure 11:
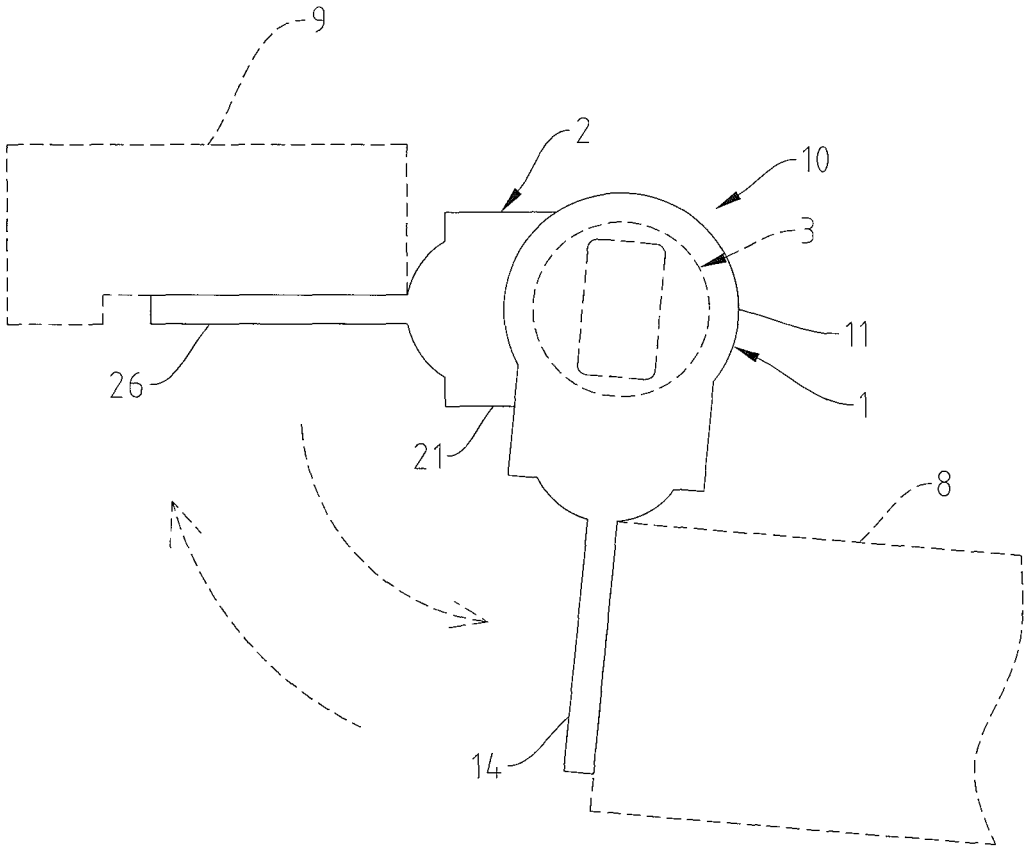
FIG. 11 is a view similar to FIG. 10, illustrating pivotal movement of the door and a first connecting member of the hinge device.

With reference to FIGS. 10 and 11, the first connecting portion 14 of the first connecting member 1 is mounted to the door 8, and the second connecting portion 26 of the second connecting member 2 is mounted to the door frame 9. After the door 8 reaches a certain opening angle, the magnetic attraction between the magnetic attraction leg 325 and the magnetically attractive portion 41 retains the door 8 in the open position.

Although specific embodiments have been illustrated and described, numerous modifications and variations are still possible without departing from the scope of the invention. The scope of the invention is limited by the accompanying claims.

The invention claimed is:

1. A hinge device comprising:

a first connecting member adapted to be mounted to a door, with the first connecting member including a receiving section, with an axle member mounted in the receiving section of the first connecting member and including an axle located outside of the receiving section;

a second connecting member adapted to be mounted to a door frame to which the door is pivotably mounted, with the second connecting member including an axle receiving portion having a first end and a second end, with a pivotal compartment defined in the first end of the axle receiving portion, with the axle pivotably received in the pivotal compartment, with a fixing groove defined in an inner periphery of the pivotal compartment; and a magnetic member mounted in the fixing groove, with the magnetic member including a magnetically attractive portion located in the pivotal compartment, wherein when the first connecting member and the axle member pivot, the axle of the axle member pivots between a first position adjacent to the magnetically attractive portion and a second position away from the magnetically attractive portion, and wherein the axle in the first position is attracted and positioned by a magnetic attraction force of the magnetically attractive portion.

2. The hinge device as claimed in claim 1, with the receiving section of the first connecting member including an end facing the axle receiving portion of the second connecting member, with a positioning compartment defined in the end of the receiving section of the first connecting member, with the axle of the axle member including a positioning portion positioned in the positioning compartment, and with the axle located outside of the positioning compartment.

3. The hinge device as claimed in claim 2, with the positioning compartment of the receiving section of the first connecting member including an inner periphery having an annular positioning groove, with the positioning portion of the axle member including a receptacle defined in an outer periphery thereof, with an elastic element and a limiting pin received in the receptacle, with the limiting pin biased by the elastic element to extend out of the receptacle, and with a distal end of the limiting pin received in the annular positioning groove.

4. The hinge device as claimed in claim 1, with the axle including a column received in the pivotal compartment, with the column including a cutout in a side thereof and a magnetic attraction leg delimiting the cutout, with the magnetic attraction leg including an abutment face, with the magnetically attractive portion of the magnetic member located in the cutout, wherein when the axle is in the first position adjacent to the magnetically attractive portion, the magnetically attractive portion attracts the abutment face of the magnetic attraction leg to position the first connecting member relative to the second connecting member.

5. The hinge device as claimed in claim 4, with the column including an end face facing the cutout, with a first positioning hole defined in the end face of the column, with a second positioning hole defined in a bottom wall of the pivotal compartment of the axle receiving portion, with a post mounted in the pivotal compartment and including two ends respectively received in the first and second positioning holes, with the magnetically attractive portion of the magnetic member including a recessed abutment surface, and with the recessed abutment surface abutting an outer periphery of the post.

6. The hinge device as claimed in claim 4, with the axle receiving portion further including an annular positioning groove in the inner periphery of the pivotal compartment, with the axle including a receptacle in an outer periphery thereof, with an elastic element and a limiting pin received in the receptacle, with the limiting pin biased by the elastic element to extend out of the receptacle, and with a distal end of the limiting pin received in the annular positioning groove.

* * * * *